US006174585B1

(12) United States Patent
Miles

(10) Patent No.: US 6,174,585 B1
(45) Date of Patent: Jan. 16, 2001

(54) SLATS FOR FURNITURE

(76) Inventor: John Radway Miles, 34A Campden Hill Gardens, London (GB), W8 7AZ ( * ) Notice: Under 35 U.S.C. 154(b), the term of this patent shall be extended for 0 days.

(21) Appl. No.: 09/142,534

(22) PCT Filed: Mar. 5, 1997

(86) PCT No.: PCT/GB97/00598

§ 371 Date: Sep. 8, 1998

§ 102(e) Date: Sep. 8, 1998

(87) PCT Pub. No.: WO97/23507

PCT Pub. Date: Sep. 12, 1997

(30) Foreign Application Priority Data

Mar. 6, 1996 (GB) ..... 9604745

(51) Int. Cl.[7] ..... A47C 4/00; A47C 7/16; A47C 13/00

(52) U.S. Cl. ..... 428/122; 428/131; 428/119; 428/83; 428/358; 297/118; 297/129; 297/16.1; 297/19

(58) Field of Search ..... 428/131, 122, 428/119, 83, 358; 297/118, 129, 16.1, 19

(56) References Cited

U.S. PATENT DOCUMENTS 4,608,796 * 9/1986 Shea, Jr. ..... 52/399
5,190,803 * 3/1993 Goldbach et al. ..... 428/138
5,406,760 * 4/1995 Edwards ..... 52/239

FOREIGN PATENT DOCUMENTS 0 123 078 A2 3/1984 (EP) .
2 243 543 11/1991 (GB) .

* cited by examiner

*Primary Examiner*—William P. Watkins, III
(74) *Attorney, Agent, or Firm*—James Creighton Wray; Meera P. Narasimhan

(57) ABSTRACT

A slat (116) is arranged to co-operate with substantially similar slats (117) for the construction of structures, primarily garden furniture. Each slat defines a substantially C-shaped cross section with a central element (501) and two longitudinal elements (502, 503) attached to the central element. Locking teeth (505) are applied to an external surface (504) of the central element, arranged to radially extend about a connecting hole (506). The connecting hole receives a spindle (507) arranged to securely hold the slats in position. With the spindle loosened, it is possible to re-configure the furniture for different purposes. However, with the spindle held tightly in place, the furniture becomes rigid and suitable for supporting body weight.

6 Claims, 6 Drawing Sheets

SLATS FOR FURNITURE

The present invention relates to slats arranged to co-operate with substantially similar slats for the construction of furniture.

INTRODUCTION

An item of furniture constructed from an arrangement of slats is described in United Kingdom Patent 2 243 543, granted to the present Applicant. The slats may be moved to a plurality of positions, thereby allowing the item of furniture to take on many configurations, including that of a chair, a table and a sun lounger etc.

A problem with the known arrangement is that the fabrication of each slat requires a plurality of moulding processes to be effected, primarily to ensure that mutually co-operating engaging devices, in the form of radial teeth, are provided on each co-operating surface.

SUMMARY OF THE INVENTION

According to a first aspect of the present invention, there is provided a slat arranged to co-operate with substantially similar slats for the construction of furniture, in which each slat defines a substantially C-shaped cross section comprising a central element, a first longitudinal element and a second longitudinal element; wherein said central element defines an internal surface adjacent to said longitudinal elements; said central elements defines an external surface; locking means extend from said external surface so as to engage locking means of a co-operating slat; and a plurality of reinforcing webs are positioned within said C-shaped cross section defining substantially diamond-shaped arrangements.

In a preferred embodiment, the locking means comprises co-operating teeth and said teeth may extend radially from a circular hole. Preferably, the circular hole is arranged to receive a restraining spindle and said spindle may be arranged to hold a plurality of interdigitated slats.

An advantage of the invention is that the moulding of each individual slat may be exercised as a single operation. Although the number of co-operating devices has been reduced over the system known in the prior art, it has been found that the structure is still firmly held in position. In addition the C-shaped cross section also facilitates the addition of structural cross members, so as to enhance the torsional rigidity of the strut.

DETAILED DESCRIPTION OF THE EMBODIMENTS

The invention will now be described by way of example only, with reference to the accompanying drawings identified above.

Figure 1:
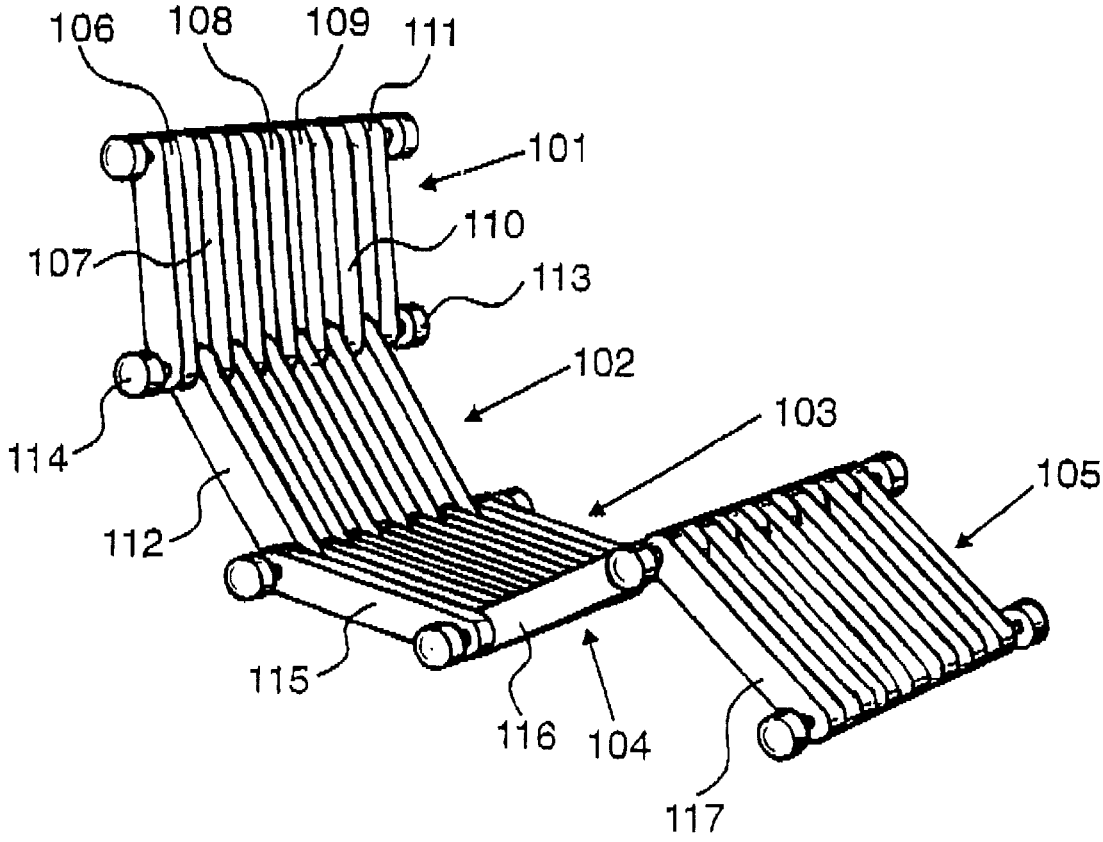
FIG. 1 shows an item of furniture constructed from a plurality of inter-connected slats and configured for use as a sun lounger.

An item of furniture is shown in FIG. 1, constructed from a plurality of slats, interconnected in such a way as to allow the assembly to be used for many different types of furniture. In the arrangement shown in FIG. 1, the arrangement is particularly suitable for use as a sun lounger, although the actual angular displacement between slats may be adjusted to provide alternative functionality or to meet with particular personal tastes.

The whole unit may be considered as consisting of five connected panels, 101, 102, 103, 104 and 105. Each panel is configured from a plurality of slats interdigitated with similar slats of the co-operating panel. Thus, as shown in the example of FIG. 1, panel 101 comprises slats 107 to 111. Similarly, panel 2 includes a first slat 112 along with six similar slats, such that the top end of slats forming panel 102 are interdigitated with the bottom of slats 106 to 111 defining panel 101.

Adjoining panels are held together by means of a spindle 113, having a co-operating bolt 114.

The third panel 103 is initiated by slat 115, with the fourth panel 104 being initiated by slat 116 and the fifth panel 105 being initiated by slat 117. Thus, a spindle interconnects slats 112 and 115, with a further spindle interconnecting slats 115 and 116 and a further spindle interconnecting slats 116 and 117. The unconnected ends of panels 101 and 105 are also held together by similar spindles, in combination with spacer rings located at positions where interdigitated slats exist for the intermediate spindles.

Figure 2:
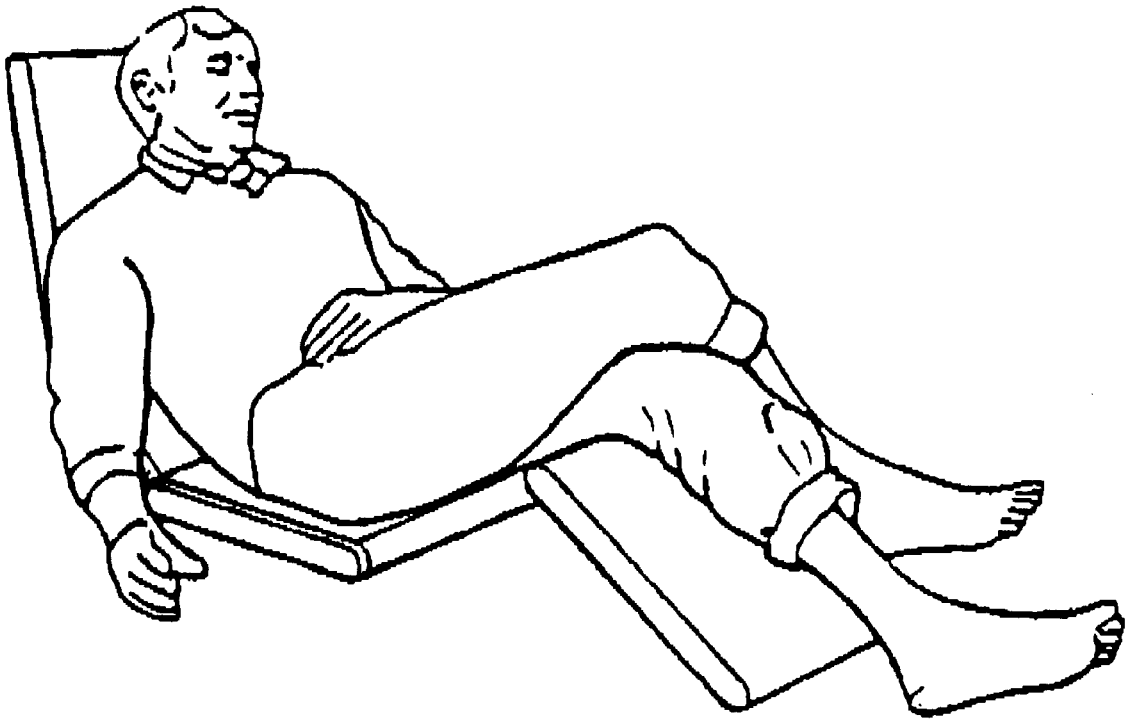
FIG. 2 shows the structure of FIG. 1 in use as a sun lounger.

The arrangement shown in FIG. 1 has been configured to provide a sun lounger and use of the device as a sun lounger is illustrated in FIG. 2, along with a gentleman bearing some resemblance to the inventor.

Figure 3:
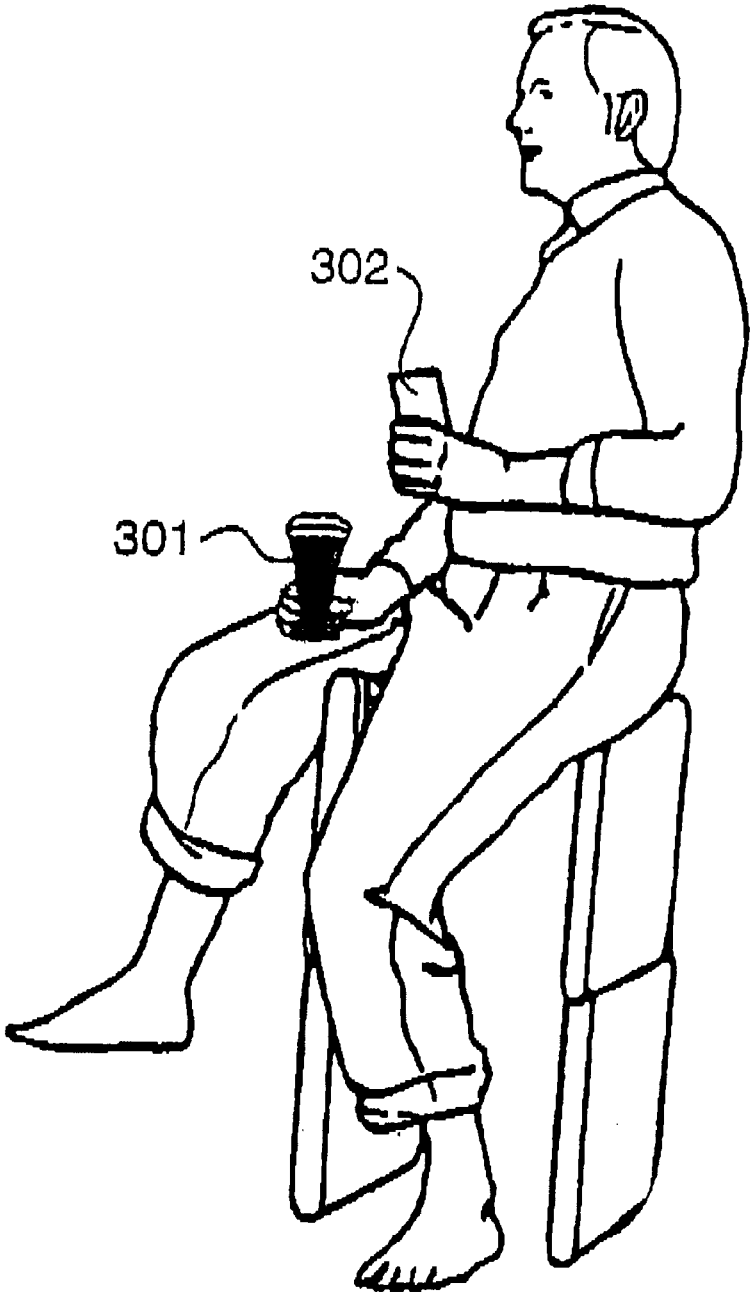
FIG. 3 shows the structure of FIG. 1 modified for use as a stool.

In FIG. 3, the gentleman shown in FIG. 2 has decided to take a break from his sun lounging and to re-configure the device as a stool, so that he may take an opportunity to enjoy a glass of beer 301 and a sandwich 302. This is achieved by loosening locking nuts 114 to allow the interdigitated slats to be rotated about said spindles, thereby achieving an alternative configuration. When the adaptation has been made, the locking bolts are re-tightened so as to hold the structure firmly in position.

Figure 4:
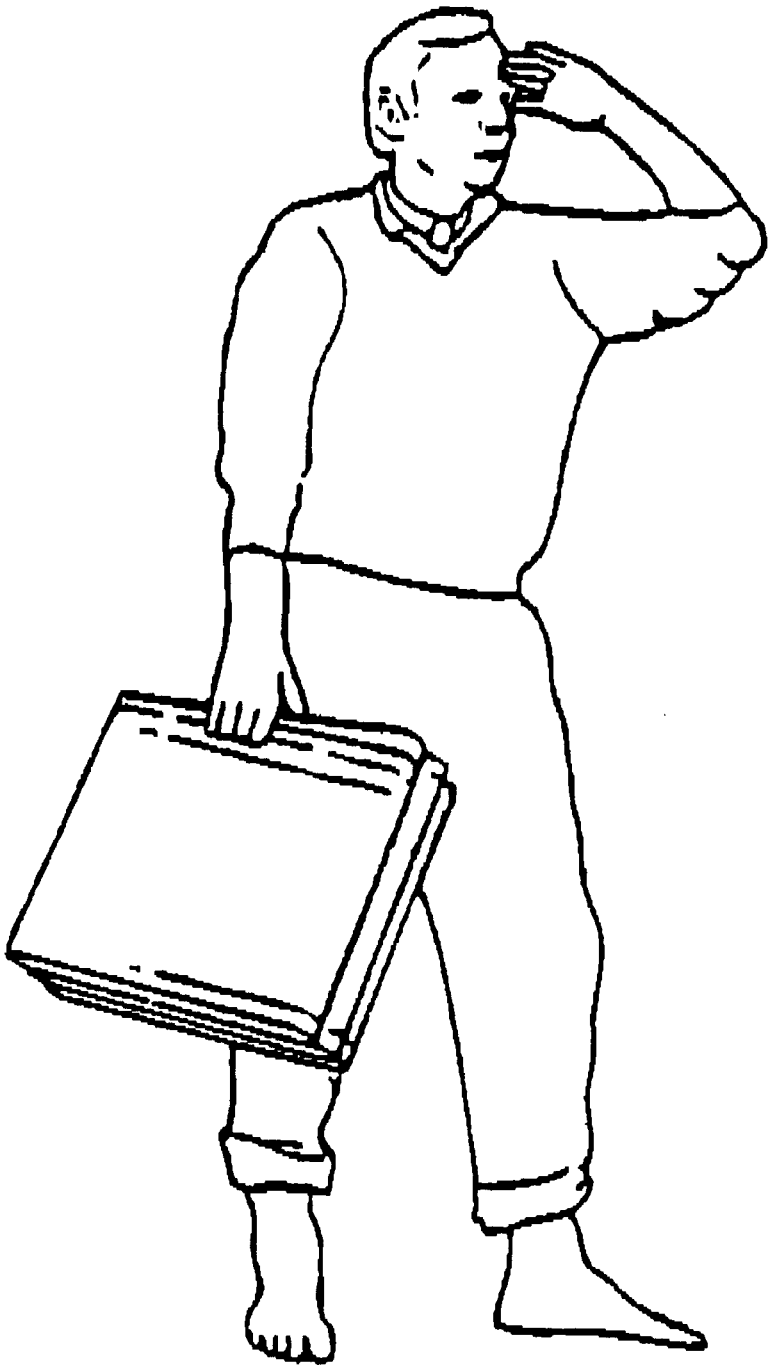
FIG. 4 shows the structure of FIG. 1 folded up for transportation.

Many modifications of this type may be made and the adjustments also allow the structure to be folded up into a convenient arrangement for transportation, as illustrated in FIG. 4. Thus, the gentleman may look to identify a more appropriate resting position and then fold up the device into an easily transportable package such that it may be subsequently reassembled for appropriate use. Furthermore, in addition to the sun lounger shown in FIG. 2 and the stool shown in FIG. 3, other arrangements may be configured including tables and chairs etc.

Figure 5:
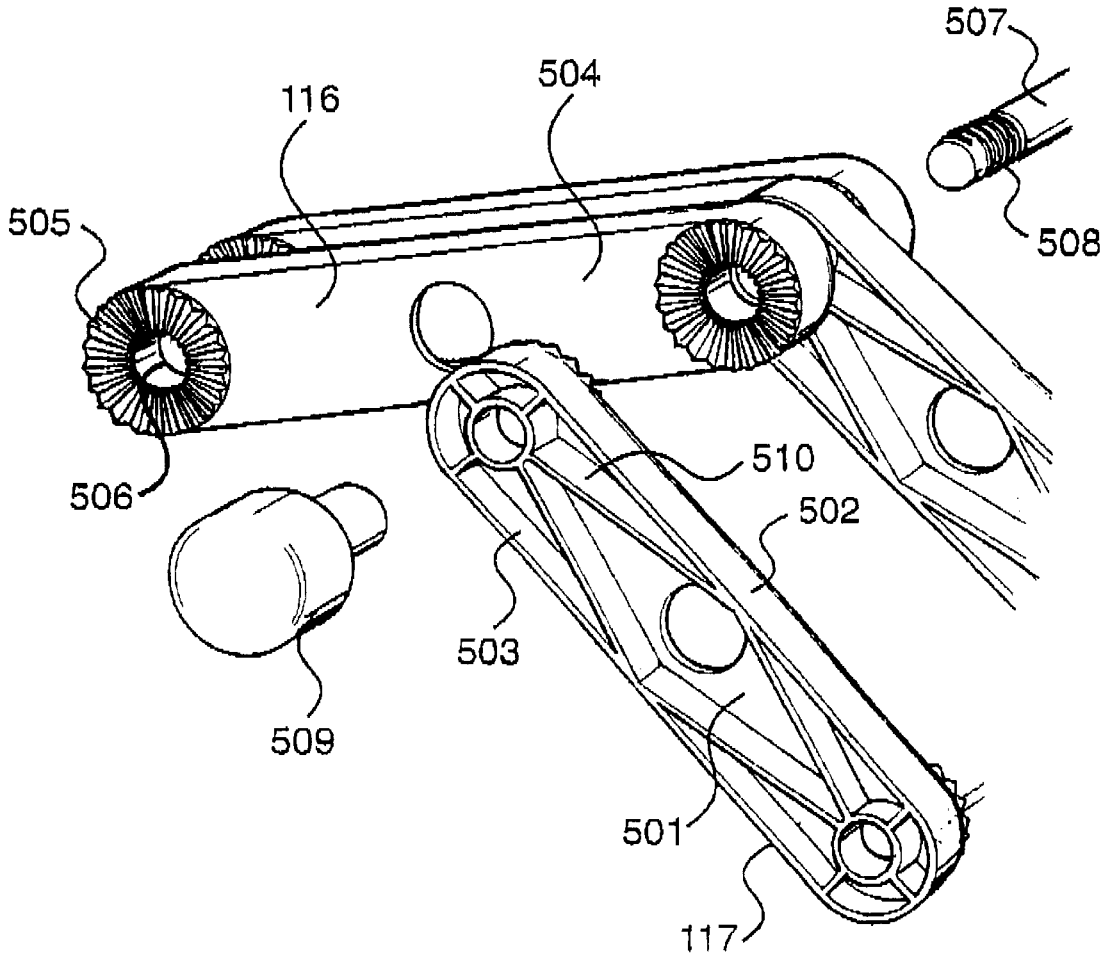
FIG. 5 details the interconnection of struts of the type shown in FIG. 1.

An exploded view of slat 116 co-operating with slat 117 is illustrated in FIG. 5. Each slat, including slat 117, defines a substantially C-shaped cross section comprising a central element 501, a first longitudinal element 502 and a second longitudinal element 503. The central element defines an internal surface, as shown in strut 117, adjacent to the similar internal surfaces of longitudinal elements 502 and 503. An external surface 504 of a central element is shown for co-operating strut 116. Each external surface 504 includes locking teeth 505 radially extending from a connecting hole 506. Connecting holes 506 are arranged to receive a connecting spindle 507.

Spindle 507 is arranged to enter co-operating holes of interdigitated slats, whereafter a thread 508 tapped on spindle 507 engages locking bolt 509. As the locking bolt

509 is engaged with thread 508 the interdigitated slats are brought closer together until adjoining external surfaces, such as surface 504, lock into position by means of the teeth, such as teeth 505. In this configuration further axial rotation about the spindle 507 is prevented and the teeth are defined at a sufficient gauge to prevent rotation about spindle 507 under loading typical of that present within structures defining furniture etc.

The C-shaped arrangement of the struts facilitates the moulding of said struts, such that the locking teeth 505 are created as a single impression with the moulding of the strut; the strut itself being fabricated from plastics material such as polypropylene. Within the cavity defined by internal surface 501 and the longitudinal members 502, 503, torsional flexing is more prevalent in a C-shaped member compared to an I-shaped member. However, the C-shaped member does facilitate the construction of re-enforcing webs 510, four of which are illustrated in the strut shown in FIG. 5.

Figure 6:
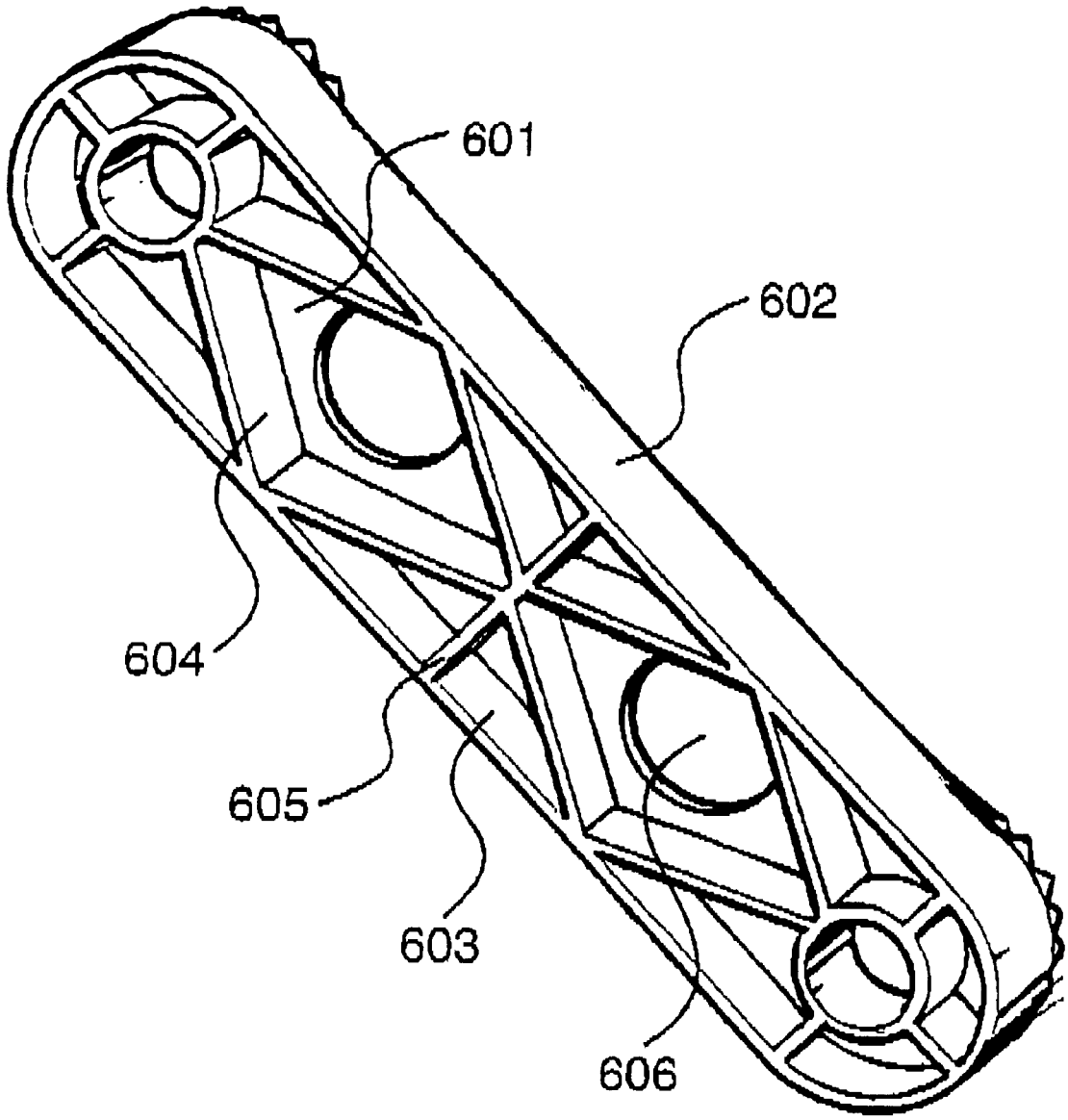
FIG. 6 shows an alternative strut to that shown in FIG. 5.

An alternative arrangement of webbing is shown in FIG. 6. The strut of FIG. 6 also includes a central element 601, along with longitudinal elements 602 and 603. Here, the periodicity of the webbing within the C-shaped channel has been doubled, providing a total of eight webs 604 in a substantially diamond shaped arrangement. A cross member 605 also connects the longitudinal elements 602, 603. If required, holes 606 are defined within the central element 601. These holes do not reduce the rigidity of the structure significantly but do reduce material costs and overall weight.

What is claimed is:

1. A slat arranged to co-operate with substantially similar slats included within furniture suitable for use as a seat, in which each slat consists of a plastics material and defines a substantially C-shaped cross section comprising a central element, a first longitudinal element and a second longitudinal element; wherein said central element defines an internal surface adjacent to said longitudinal elements;

said central element defines an external surface;

locking means extend from said external surface so as to engage locking means of a co-operating slat; and a plurality of reinforcing webs are positioned within said C-shaped cross section defining substantially diamond-shaped arrangements.

2. A slat according to any of claim 1, wherein said locking means comprises co-operating teeth.

3. A slat according to claim 2, wherein said teeth extend radially from a circular hole.

4. A slat according to claim 3, wherein said circular hole is arranged to receive a restraining spindle.

5. A slat according to claim 4, wherein said spindle is arranged to hold a plurality of interdigitated slats.

6. A slat according to claim 1, wherein all locking means included in said slat extend from said external surface.

* * * * *